US009644430B2

(12) United States Patent
Scott et al.

(10) Patent No.: US 9,644,430 B2
(45) Date of Patent: May 9, 2017

(54) CUTTING ELEMENTS FOR EARTH-BORING TOOLS, EARTH-BORING TOOLS INCLUDING SUCH CUTTING ELEMENTS, AND RELATED METHODS

(71) Applicant: Baker Hughes Incorporated, Houston, TX (US)

(72) Inventors: Danny E. Scott, Montgomery, TX (US); Rudolf Carl Pessier, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 372 days.

(21) Appl. No.: 13/840,014

(22) Filed: Mar. 15, 2013

(65) Prior Publication Data

US 2014/0262540 A1 Sep. 18, 2014

(51) Int. Cl.

| | |
|---|---|
| ***E21B 10/573*** | (2006.01) |
| ***E21B 10/55*** | (2006.01) |
| ***B24D 99/00*** | (2010.01) |
| *E21B 10/56* | (2006.01) |

(52) U.S. Cl.

CPC ..... *E21B 10/5735* (2013.01); *B24D 99/005* (2013.01); *E21B 10/55* (2013.01); *E21B 2010/565* (2013.01)

(58) Field of Classification Search

CPC ..... E21B 10/56; E21B 2010/561; E21B 2010/565; E21B 10/46; E21B 10/567; E21B 10/5673; E21B 10/5735

See application file for complete search history.

(56) References Cited

U.S. PATENT DOCUMENTS

| | | | | |
|---|---|---|---|---|
| 4,224,380 | A | 9/1980 | Bovenkerk et al. | |
| 5,127,923 | A | 7/1992 | Bunting et al. | |
| 5,447,208 | A | 9/1995 | Lund et al. | |
| 5,653,300 | A | 8/1997 | Lund et al. | |
| 6,145,607 | A | 11/2000 | Griffin et al. | |
| 6,145,608 | A | 11/2000 | Lund et al. | |
| 6,401,844 | B1 | 6/2002 | Doster et al. | |
| 8,191,658 | B2 | 6/2012 | Schmitz et al. | |
| 2009/0114628 | A1 | 5/2009 | DiGiovanni | |
| 2009/0321146 | A1 | 12/2009 | Dick et al. | |
| 2010/0270087 | A1* | 10/2010 | Marvel et al. | 175/426 |
| 2011/0259642 | A1* | 10/2011 | DiGiovanni et al. | 175/57 |
| 2012/0103700 | A1 | 5/2012 | Lin | |

(Continued)

OTHER PUBLICATIONS

International Search Report for International Application No. PCT/US2014/028342 dated Aug. 12, 2014, 3 pages.

(Continued)

*Primary Examiner* — Brad Harcourt
(74) *Attorney, Agent, or Firm* — TraskBritt

(57) ABSTRACT

A cutting element for an earth-boring tool includes a substrate and a volume of superabrasive material disposed over the substrate. The volume of superabrasive material may include a cutting face and a longitudinal extension extending longitudinally along a lateral side surface of the substrate. An outer peripheral surface of the longitudinal extension may define at least a portion of a lateral side surface of the cutting element and may have a surface roughness less than about 10 μin. (about 0.254 μm) RMS. Earth-boring tools may include such cutting elements. Methods may include forming such cutting elements.

20 Claims, 7 Drawing Sheets

(56) References Cited

U.S. PATENT DOCUMENTS

| | | | |
|---|---|---|---|
| 2012/0205162 | A1 | 8/2012 | Patel et al. |
| 2012/0247834 | A1 | 10/2012 | Buxbaum et al. |

OTHER PUBLICATIONS

International Written Opinion for International Application No. PCT/US2014/028342 dated Aug. 12, 2014, 10 pages.
Bilen et al., U.S. Appl. No. 13/461,388 entitled, Earth-Boring Tools Having Cutting Elements With Cutting Faces Exhibiting Multiple Coefficients of Friction, and Related Methods, filed May 1, 2012.

* cited by examiner

CUTTING ELEMENTS FOR EARTH-BORING TOOLS, EARTH-BORING TOOLS INCLUDING SUCH CUTTING ELEMENTS, AND RELATED METHODS

TECHNICAL FIELD

Embodiments of the present disclosure relate to earth-boring tools, cutting elements for such earth-boring tools, and related methods.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

BRIEF SUMMARY

This summary does not identify key features or essential features of the claimed subject matter, nor does it limit the scope of the claimed subject matter in any way.

In some embodiments, the present disclosure includes a cutting element for an earth-boring tool. The cutting element comprises a substrate and a volume of superabrasive material disposed over the substrate. The volume of superabrasive material includes a first major surface comprising a front cutting face of the volume of superabrasive material.

The volume of superabrasive material also includes a longitudinal extension extending longitudinally along a lateral side surface of the substrate. The longitudinal extension has an outer peripheral surface that defines at least a portion of a lateral side surface of the cutting element, wherein at least a portion of the outer peripheral surface of the longitudinal extension has a surface roughness less than about 10 μin. (about 0.254 μm) RMS.

In additional embodiments, the present disclosure includes an earth-boring tool having a tool body with at least one cutting element affixed thereto. The at least one cutting element comprises a substrate and a volume of superabrasive material disposed over the substrate. The volume of superabrasive material includes a first major surface comprising a front cutting face of the volume of superabrasive material. The volume of superabrasive material also includes a longitudinal extension extending longitudinally along a lateral side surface of the substrate. The longitudinal extension has an outer peripheral surface that defines at least a portion of a lateral side surface of the at least one cutting element, wherein at least a portion of the outer peripheral surface of the longitudinal extension has a surface roughness less than about 10 μin. (about 0.254 μm) RMS.

In additional embodiments, the present disclosure includes a method of forming a cutting element for an earth-boring tool. The method comprises providing a substrate and disposing a volume of superabrasive material over the substrate. The volume of superabrasive material includes a first major surface comprising a front cutting face of the volume of superabrasive material. The volume of superabrasive material also includes a longitudinal extension extending longitudinally along a lateral side surface of the substrate. The longitudinal extension has an outer peripheral surface that defines at least a portion of a lateral side surface of the cutting element. The method also includes polishing at least a portion of the outer peripheral surface of the longitudinal extension to a surface roughness less than about 10 μin. (about 0.254 μm) RMS.

Yet further embodiments of the present disclosure include forming a cutting element using a method as described herein, and attaching the cutting element to a body of an earth-boring tool.

BRIEF DESCRIPTION OF THE DRAWINGS

While the specification concludes with claims particularly pointing out and distinctly claiming what are regarded as embodiments of the present disclosure, various features and advantages of this disclosure may be more readily ascertained from the following description of example embodiments of the disclosure provided with reference to the accompanying drawings.

DETAILED DESCRIPTION

Figure 1:
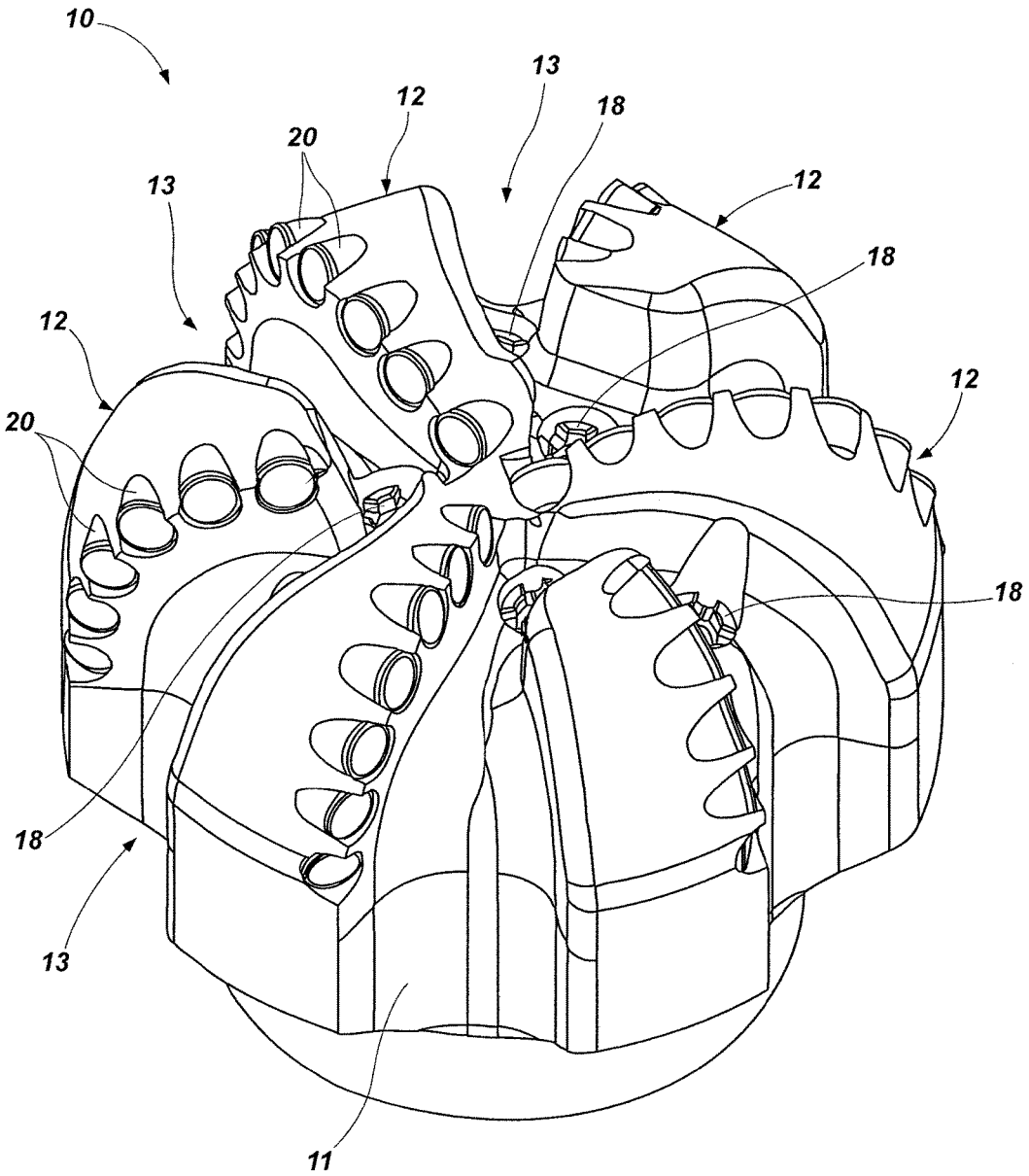
FIG. 1 illustrates a perspective view of an earth-boring tool comprising a fixed-cutter rotary drill bit, which includes cutting elements as described herein attached to a body of the drill bit, according to an embodiment of the present disclosure.

The illustrations presented herein are not actual views of any particular earth-boring tool, drill bit, cutting element, or component of such a tool or bit, but are merely idealized representations that are employed to describe embodiments of the present disclosure.

In a drilling operation, deleterious downhole conditions may result from degradation of cutting elements during use. For example, as a cutting element engages uncut formation material, a "wear-flat," as the term is know in the art, may commence at a point of contact between the cutting element and the formation material being cut. The wear-flat may grow as the formation abrades against exposed surfaces of the cutting element and constituent components, such as a volume of superabrasive material and a supporting substrate. Over time, the wear-flat may become progressively enlarged as more of the cutting element is worn away, reducing the thermal and structural integrity of the cutting element, resulting in deleterious and even catastrophic effects in the cutting element, a drill bit attached thereto, and even the entire drill string. To compensate, a cutting element may be configured with a volume of superabrasive material having an extended portion with an outer periphery forming part of the lateral side surface of the cutting element. The extended portion and outer periphery thereof may extend rearward from a front cutting face and terminate proximate a rear surface of the cutting element. Such an extended portion may be enhanced by modifying the outer periphery thereof to have a reduced surface roughness.

As used herein, the term "earth-boring tool" means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools, etc.

As used herein, the term "cutting element" means and includes any element of an earth-boring tool that is used to cut or otherwise disintegrate formation material when the earth-boring tool is used to form or enlarge a bore in the formation.

As used herein in relation to a cutting element or a component thereof, the term "front" means and includes a side, surface, or other element generally facing the direction of movement of the cutting element as the cutting element engages uncut subterranean formation material.

As used herein in relation to a cutting element or a component thereof, the terms "rear" and "back" mean and include a side, surface, or other element generally facing away from the direction of movement of the cutting element as the cutting element engages uncut subterranean formation material.

As used herein, the term "polish," and any derivative thereof, when used to describe a condition of a surface of a volume of superabrasive material or a substrate of a cutting element, means and includes any of the methods and/or processes disclosed herein to provide a surface having a surface roughness less than about 10 μin. (about 0.254 μm) root mean square (RMS) (all surface finishes referenced herein being (RMS).

FIG. 1 illustrates an embodiment of an earth-boring tool according to an embodiment of the present disclosure. The earth-boring tool of FIG. 1 is a fixed-cutter rotary drill bit 10 having a bit body 11 that includes a plurality of blades 12 that project outwardly from the bit body 11 and are separated from one another by fluid courses 13. The portions of the fluid courses 13 that extend along the radial sides (the "gauge" areas of the drill bit 10) are often referred to in the art as "junk slots." The bit body 11 further includes a generally cylindrical internal fluid plenum, and fluid passageways that extend through the bit body 11 to the exterior surface of the bit body 11. Nozzles 18 may be secured within the fluid passageways proximate the exterior surface of the bit body 11 for controlling the hydraulics of the drill bit 10 during drilling. A plurality of cutting elements 20, various embodiments of which are described in further detail herein below, may be mounted to one or more of the blades 12.

During a drilling operation, the drill bit 10 may be coupled to a drill string (not shown). As the drill bit 10 is rotated within the wellbore, drilling fluid may be pumped down the drill string, through the internal fluid plenum and fluid passageways within the bit body 11 of the drill bit 10, and out from the drill bit 10 through the nozzles 18. Formation cuttings generated by the cutting elements 20 of the drill bit 10 may be carried with the drilling fluid through the fluid courses 13, around the drill bit 10, and back up the wellbore through the annular space within the wellbore outside the drill string.

Figure 2:
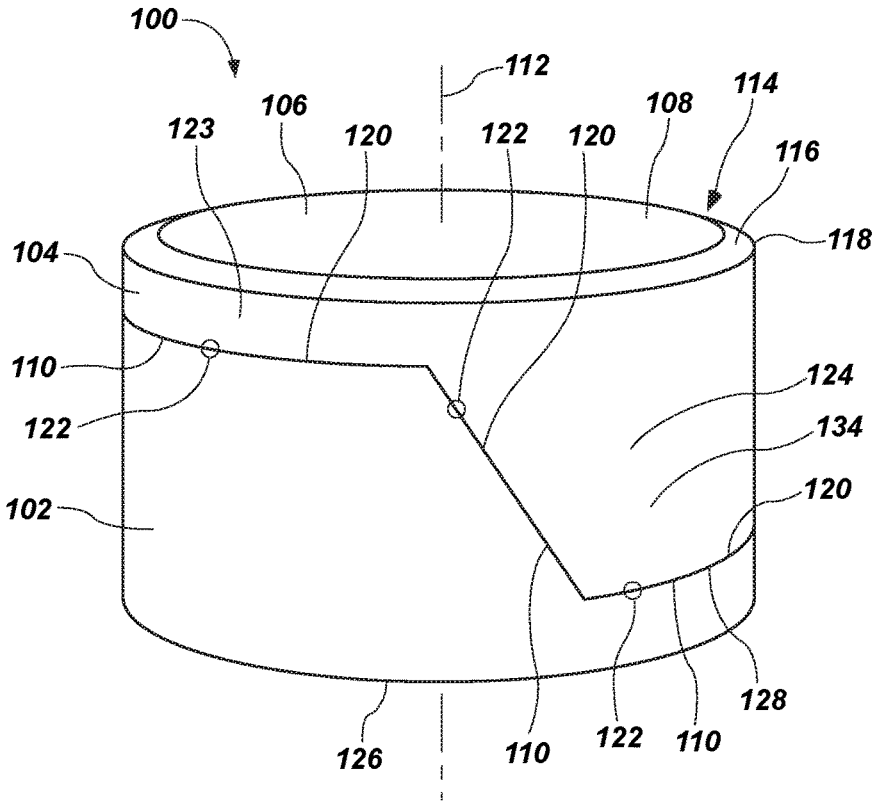
FIG. 2 illustrates a perspective view of a cutting element having a volume of superabrasive material with a longitudinal extension protruding into a substrate underlying the volume of superabrasive material, according to an embodiment of the present disclosure.
Figure 3:
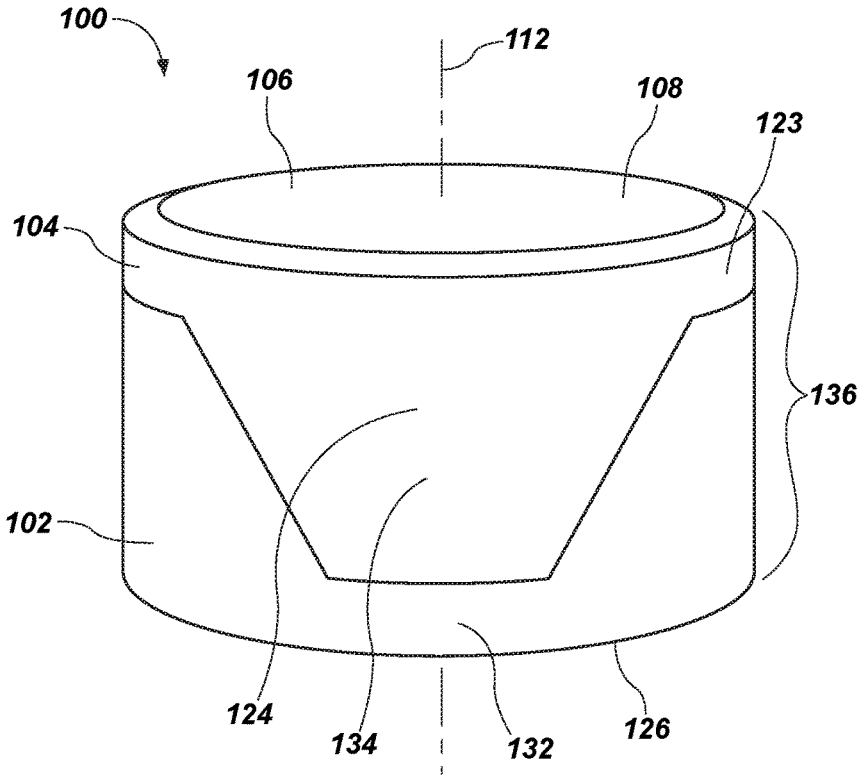
FIG. 3 illustrates a perspective view of the cutting element of FIG. 2 rotated about a longitudinal axis of the cutting element to display a full periphery of the longitudinal extension of the volume of superabrasive material, according to an embodiment of the present disclosure.
Figure 4:
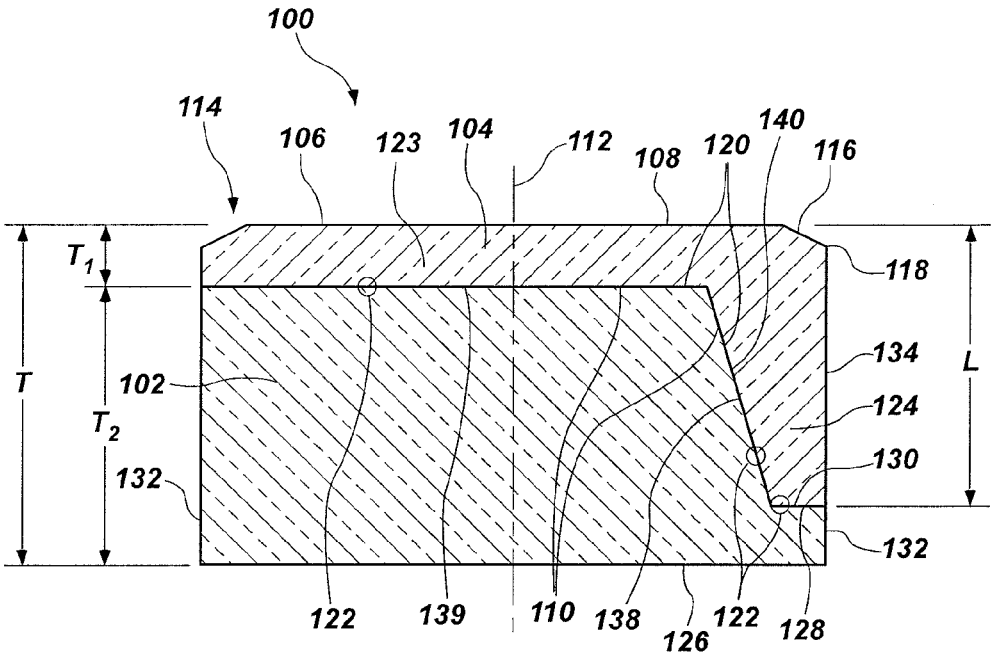
FIG. 4 illustrates a cross-sectional view of the cutting element of FIGS. 2 and 3, depicting a major surface of the volume of superabrasive material defining the longitudinal extension of the volume of superabrasive material, according to an embodiment of the present disclosure.

FIGS. 2 through 4 illustrate a cutting element 100 according to an embodiment of the present disclosure. The cutting element 100 may include a cutting element substrate 102 and a volume of superabrasive material 104 disposed on the substrate 102. The volume of superabrasive material 104 may comprise, for example, polycrystalline diamond (PCD) or polycrystalline cubic boron nitride. When the volume of superabrasive material 104 comprises diamond, the volume of superabrasive material 104 is often referred to in the art as a "diamond table." Additionally, the substrate 102 and the volume of superabrasive material 104 may each have a generally cylindrical shape, as shown; although it is to be appreciated that other shapes are within the scope of the embodiments disclosed herein. With continued reference to FIGS. 2 through 4, a front side 106 of the volume of superabrasive material 104 may include a major surface defining a front cutting face 108 of the cutting element 100, and a rear side 110 of the volume of superabrasive material 104 may be located opposite the front side 106. The front cutting face 108 may be substantially planar and oriented generally perpendicular to a longitudinal axis 112 of the cutting element 100; although, in other embodiments, the front cutting face 108 may have three-dimensional elements and/or may be oriented at a non-perpendicular angle with respect to the longitudinal axis 112 of the cutting element 100. Optionally, the cutting face 108 may include a chamfered peripheral edge 114 of the volume of superabrasive material 104. The chamfered peripheral edge 114 may include a single chamfer surface 116. An outer peripheral edge of the chamfer surface 116 may form a cutting edge 118 of the cutting element 100.

With continued reference to FIGS. 2 through 4, the rear side 110 of the volume of superabrasive material 104 may be attached to a front side 120 of the substrate 102. The front side 120 of the substrate 102 may be shaped in a conformal manner with the rear side 110 of the volume of superabrasive material 104, wherein the rear side 110 of the volume of superabrasive material 104 and the front side 120 of the substrate 102 are attached at an interface 122 between the volume of superabrasive material 104 and the substrate 102. In alternative embodiments, one or more layers of material may be disposed between the volume of superabrasive material 104 and the substrate 102, as is known in the art. The volume of superabrasive material 104 may include a first portion 123 and a longitudinal extension 124 that extends longitudinally along a lateral side surface of the substrate 102 toward to a rear surface 126 of the substrate 102 beyond the first portion 123 of the volume of superabrasive material 104. The longitudinal extension 124 may protrude into a portion of the substrate 102 from at least one of a radial direction and a longitudinal direction. A back end 128 of the longitudinal extension 124 may be located proximate the rear surface 126 of the substrate 102. For example, as more fully shown in FIG. 4, the back end 128 of the longitudinal extension 124 may abut a landing 130 of the substrate 104 radially inset from an outermost peripheral surface 132 of the substrate 102. The back end 128 of the longitudinal extension 124 and the landing 130 of the substrate 102 may be planar, although, in other embodiments, the back end 128 of the longitudinal extension 124 and the front landing 130 of the substrate 102 may be non-planar and/or irregular in shape. In yet additional embodiments, such as the embodiment illustrated in FIG. 5A, the back end 128 of the longitudinal extension 124 may be flush with the rear surface 126 of the substrate 102.

An outer peripheral surface 134 of the longitudinal extension 124 may be flush with the outermost peripheral surface 132 of the substrate 102 in a manner such that the outer peripheral surface 134 of the longitudinal extension 124 and the outermost peripheral surface 132 of the substrate 102 together form a lateral side surface 136 of the cutting element 100. The longitudinal extension 124 may include a radially inward surface 138 extending from a rear surface 139 of the first portion 123 of the volume of superabrasive material 104 to the back end 128 of the longitudinal extension 124. The radially inward surface 138 of the longitudinal extension 124 may be conformal with and abut a radially inward surface 140 of the substrate 102.

The radially inward surface 138 of the longitudinal extension 124 may extend at an angle with respect to the longitudinal axis 112 of the cutting element 100, causing the longitudinal extension 124, when viewed along a cross section in a plane extending through the center of the cutting element 100 and parallel with the longitudinal axis 112 thereof, as shown in FIG. 4, to taper from the rear surface 139 of the first portion 123 of the volume of superabrasive material 104 to the back end 128 of the longitudinal extension 124. In other embodiments, the longitudinal extension 123 may taper from the rear surface 139 of the first portion 123 of the volume of superabrasive material 104 to the outer peripheral surface 134 of the longitudinal extension 124. In yet other embodiments, the radially inward surface 138 of the longitudinal extension 124 may extend substantially parallel with the longitudinal axis 112 of the cutting element 100. It is to be appreciated that interfacing surfaces between the substrate 102 and the volume of superabrasive material 104, such as the back end 128 and the radially inward surface 138 of the longitudinal extension 124, the rear surface 139 of the first portion 123 of the volume of superabrasive material 104, and the landing 130 and the radially inward surface 140 of the substrate 102, may include any manner of shapes, features and configurations, as is known in the art, and as more fully described in U.S. Pat. No. 6,401,844, issued Jun. 11, 2002, to Doster et al., the disclosure of which is incorporated herein in its entirety by this reference.

As shown in FIG. 4, the cutting element 100 may have a total thickness T measured from cutting face 108 to the rear surface 126 of the substrate 102. The first portion 123 of the volume of superabrasive material 104 may have a thickness $T_1$ measured from the cutting face 108 to the rear surface 139 of the first portion 123. A portion of the substrate 102 corresponding to the first portion 123 of the volume of superabrasive material 104 may have a thickness $T_2$ measured from a surface abutting the rear surface 139 of the first portion 123 of the volume of superabrasive material 104 to the rear surface 126 of the substrate 102. The thickness T may be in the range between about 5 mm and about 30 mm, the thickness $T_1$ may be in the range between about 0.2 mm and about 5.0 mm, and the thickness $T_2$ may in the range between about 25 mm and about 29.8 mm. The outer peripheral surface 134 of the longitudinal extension 124 may have a longitudinal length L measured from the front cutting face 108 to the back end 128 of the longitudinal extension 124. Longitudinal length L may be in the range of about 18 percent to about 100 percent of the thickness T of the cutting element 100. For example, in some embodiments, the longitudinal length L of the outer peripheral surface 134 of the longitudinal extension 124 may be in the range of about 18 percent to about 35 percent of the thickness T of the cutting element 100. In other embodiments, the longitudinal length L of the outer peripheral surface 134 of the longitudinal extension 124 may be in the range of about 30 percent to about 50 percent of the thickness T of the cutting element 100. In yet other embodiments, the longitudinal length L of the outer peripheral surface 134 of the longitudinal extension 124 may be in the range of about 45 percent to about 75 percent of the thickness T of the cutting element 100. In still yet other embodiments, the longitudinal length L of the outer peripheral surface 134 of the longitudinal extension 124 may be in the range of about 70 percent to about 100 percent of the thickness T of the cutting element 100.

As shown in FIGS. 2 and 3, the outer peripheral surface 134 of the longitudinal extension 124 may extend only partially around the cutting element 100 circumferentially about the longitudinal axis 112 thereof. In alternative embodiments, such as the embodiment illustrated in FIG. 5B, the outer peripheral surface 134 may extend circumferentially entirely around the cutting element 100 about the longitudinal axis 112 of the cutting element 100, in an annular configuration. In yet other embodiments, the radially inward surface 138 of the longitudinal extension 124 may include non-annular curved and/or linear segments.

In embodiments where the volume of superabrasive material 104 comprises a diamond table, the diamond table may be treated in order to reduce problems associated with different rates of thermal expansion in the polycrystalline diamond, resulting in a so-called "thermally stable" polycrystalline diamond (TSD) cutting element. Such a thermally stable polycrystalline diamond cutting element may be formed by leaching catalyst material (e.g., cobalt) out from interstitial spaces between diamond grains in the diamond table using, for example, an acid. Such a leaching process may be performed as more fully described in U.S. Pat. No. 8,191,658, issued Jun. 5, 2012, to Schmitz et al.; U.S. Pat. No. 5,127,923, issued Jul. 7, 1992, to Bunting et al.; and U.S. Pat. No. 4,224,380, issued Sep. 23, 1980, to Bovenkerk et al., the disclosure of each of which is incorporated herein in its entirety by this reference. All of the catalyst material may be removed from the diamond table, or only a portion may be removed. In reference to FIG. 4, if the volume of superabrasive material 104 comprises a diamond table, catalyst material within a predetermined depth from an exposed surface of the diamond table, such as the front cutting face 108, the chamfer surface 116, the outer peripheral surface 134 of the longitudinal extension 124, or other lateral side surface of the diamond table, may be removed by leaching. The leaching depth may vary, and may be controlled using methods known in the art. By way of non-limiting example, catalyst material may be removed from the longitudinal extension 124 to a depth of a few microns from the outer peripheral surface 134 of the longitudinal extension 124. In other embodiments, catalyst material may be removed from the longitudinal extension 124 to a depth extending from the outer peripheral surface 134 substantially to the radially inward surface 138.

The longitudinal extension 124 of the volume of superabrasive material 104 may be sized and configured such that a boundary of a wear-flat formed in the cutting element is encompassed within the longitudinal extension 124.

Figure 6:
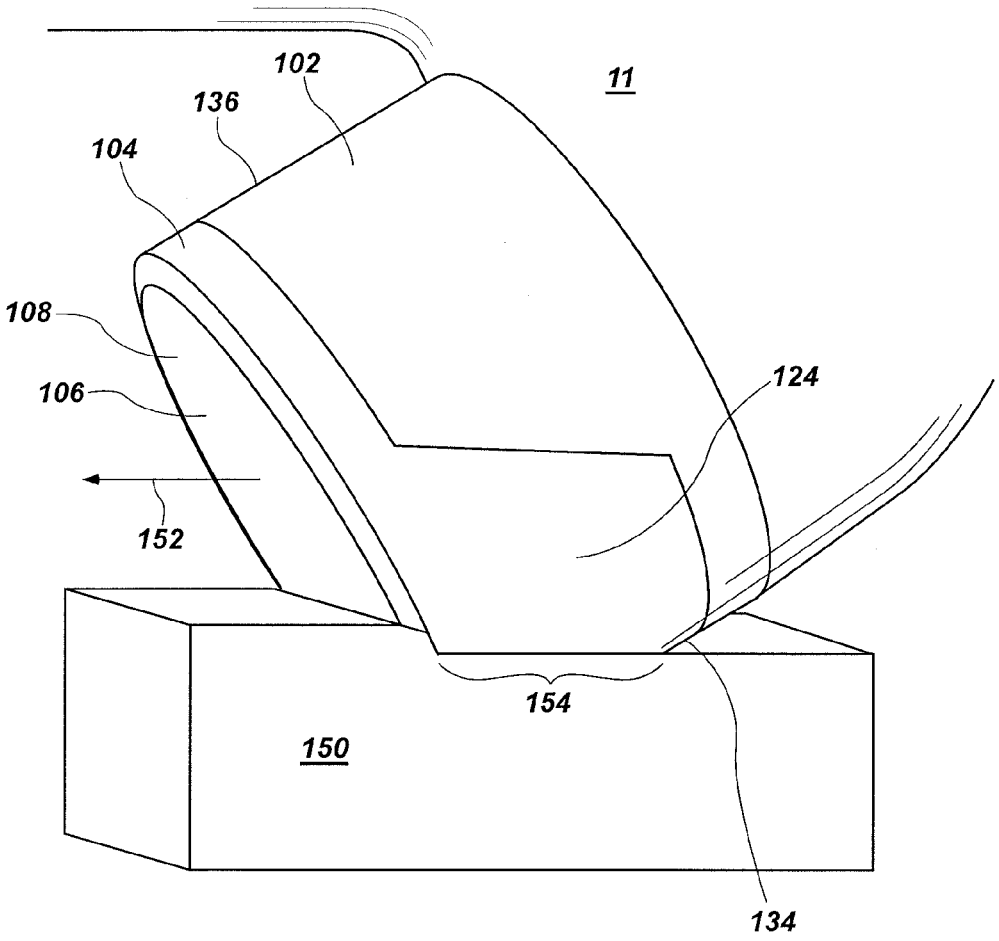
FIG. 6 illustrates a perspective view of a cutting element, according to an embodiment of the present disclosure, engaging uncut subterranean formation material at a negative rake angle, depicting a wear-flat formed only in a volume of superabrasive material of the cutting element, according to an embodiment of the present disclosure.
Figure 7:
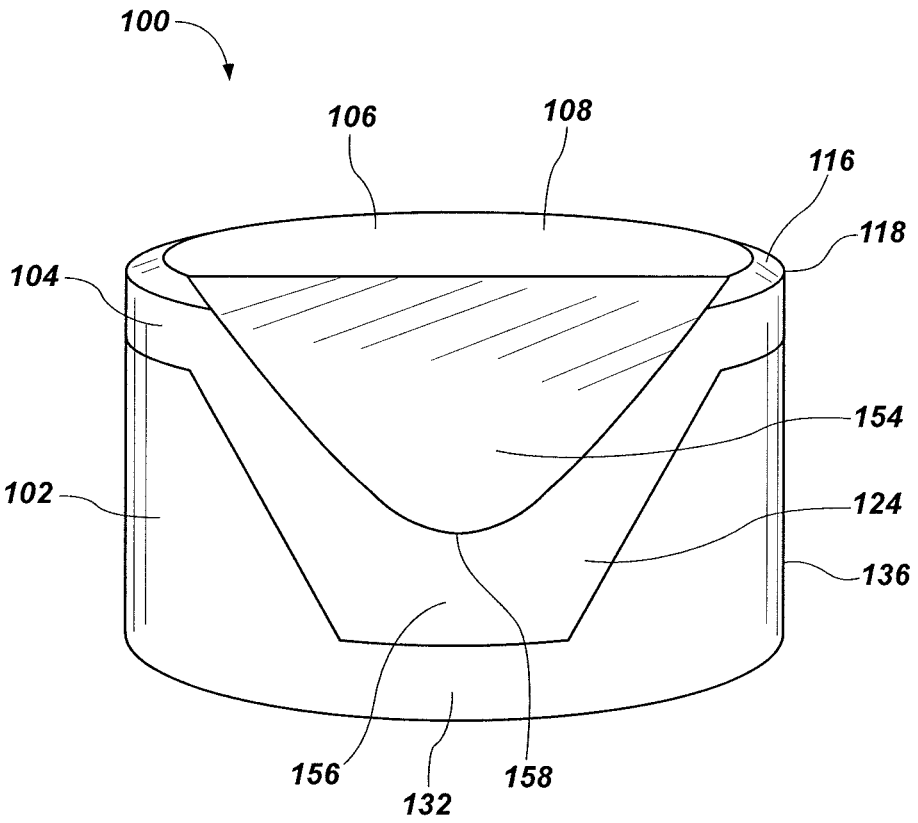
FIG. 7 illustrates a perspective view of the cutting element of FIG. 6, wherein the cutting element is oriented to illustrate a wear-flat formed only in the volume of superabrasive material of the cutting element, according to an embodiment of the present disclosure.

In FIG. 6, the cutting element 100 of FIGS. 2 through 4 is shown engaging an uncut formation 150 at a negative rake angle (i.e., a back rake angle) as the cutting element travels in the direction of arrow 152. The longitudinal extension 124 may be sized and configured to encompass the boundary of a wear-flat 154 that may be formed in the cutting element 100, as shown in FIGS. 6 and 7. In such an embodiment, the wear-flat 154 formed in the cutting element 100 may be entirely bounded within the volume of superabrasive material 104. In such embodiments, the maximum size of the wear-flat 154 may be limited by certain parameters, including a weight-on-bit (WOB) applied to the drill bit, a rake angle of the cutting element 100, and/or a depth-of-cut (DOC) limiting feature (not shown) formed on the bit body 11. For example, the longitudinal extension 124 may be sized and configured, in connection with a predetermined rake angle and maximum depth-of-cut (DOC) of the cutting element 100, to encompass an entirety of a wear-flat 154 that may form in the cutting element 100.

Physically modifying the outer peripheral surface 134 of the longitudinal extension 124 to have a reduced surface roughness decreases the amount of friction occurring at a contact region between the outer peripheral surface 134 of the longitudinal extension 124 and the formation 150. This decrease in friction allows the lateral side surface 136 of the cutting element 100 to ride more smoothly over the uncut formation 150, reducing the rate at which a wear-flat 154 may form. Such beneficial effects are increased as the surface roughness of the outer peripheral surface 134 of the longitudinal extension 124 is reduced to about 10 μin. (about 0.254 μm) RMS or less, or even about 0.5 μin. (about 0.0127 μm) RMS or less, approaching a true "mirror" finish. When a wear-flat 154 has formed, a portion 156 of the outer peripheral surface 134 succeeding a rear termination 158 of the wear-flat 154 and having a reduced surface roughness may prevent further degradation of the cutting element 100 caused by "rebound" of the uncut formation 150 against the portion 156 of the outer peripheral surface 134. So long as the rear termination 158 of the wear-flat 154 does not extend beyond the outer peripheral surface 134 of the longitudinal extension 124, substantially any uncut formation 150 that impinges against the lateral side surface 136 of the cutting element 100 may only impinge against the outer peripheral surface 134 having a reduced surface roughness.

The outer peripheral surface 134 of the longitudinal extension 124 may be physically modified to have a reduced surface roughness according to any of the methods and/or processes described in U.S. patent application Ser. No. 13/461,388, filed May 1, 2012, now U.S. Pat. No. 8,991,525, issued Mar. 31, 2015, in the name of Bilen et al.; U.S. Patent Publication No. 2009/0114628 A1, published May 7, 2009, in the name of DiGiovanni; U.S. Pat. No. 6,145,608, issued on Nov. 14, 2000, to Lund et al.; U.S. Pat. No. 5,653,300, issued Aug. 5, 1997, to Lund et al.; and U.S. Pat. No. 5,447,208, issued Sep. 5, 1995, to Lund et al., the disclosure of each of which is incorporated herein it its entirety by this reference.

As a non-limiting example, at least a portion of the outer peripheral surface 134 of the longitudinal extension 124 may be polished to a surface roughness of about 10 μin. (about 0.254 μm) RMS or less. In conventional PDC cutting elements, a surface of the cutting element 100 might be lapped to a surface roughness of 20 μin. (about 0.508 μm) to 40 μin. (about 1.02 μm) RMS, which is relatively smooth to the touch and visually planar (if the cutting face is itself flat), but which includes a number of surface anomalies and exhibits a degree of roughness that is readily visible to one even under very low power magnification, such as a 10× jeweler's loupe. However, the outer peripheral surface 134 of the longitudinal extension 124 may be treated to have a greatly reduced surface roughness.

In some embodiments, the surface roughness of at least a portion of the outer peripheral surface 134 of the longitudinal extension 124 may be reduced by lapping of the outer peripheral surface 134 on conventional cast iron laps known in the art by using progressively smaller diamond grit suspended in a glycol, glycerine or other suitable carrier liquid. The lapping may be conducted as a three-step process commencing with a 70 micron grit, progressing to a 40 micron grit and then to a grit of about 1 to 3 microns in size. In contrast, standard lapping techniques for a PDC cutting element, which may follow an initial electrodischarge grinding of the cutting face, finish lapping in one step with 70 micron grit. By way of comparison of grit size, 70 micron grit is of the consistency of fine sand or crystalline material, while 1 to 3 micron grit is similar in consistency to powdered sugar.

In additional embodiments, the surface roughness of the outer peripheral surface 134 may be reduced by placing the surface in contact with a dry, rotating diamond wheel. For example, the Winter RB778 resin bonded diamond wheel, offered by Ernst Winter & Sons, Inc. of Travelers Rest, S.C., may be utilized. It may be important that the wheel be cooled as the diamond wheel is of resin bonded construction. Elevated temperatures may result in the destruction of the wheel. The nature of the polishing process may require that the abrasive surface be kept dry. However, the wheel may be moistened with water at the start of the polishing process to reduce drag and facilitate proper orientation of the outer peripheral surface 134 against the wheel. In addition, a temperature range wherein polishing may be effected may be between about 140° F. (about 60° C.) and about 220° F. (about 104° C.). While specific polishers employed may rotate at about 3500 RPM, it is believed that a range between about 3000 RPM and about 5000 RPM would likely be adequate. About 2 lb. force (about 0.9 Kg) to about 8 lb. force (about 3.6 Kg) may be applied to the outer peripheral surface 134 against the wheel. As noted, the finish of the outer peripheral surface 134 may be smoothed to about 0.5 μin. (about 0.0127 μm) RMS or less surface roughness approaching a true "mirror" finish. To polish such surfaces, the outer peripheral surface 134 is disposed at the desired angle to the rotating wheel. The cutting element 100 may then be rotated about an axis of symmetry to smooth and polish the outer peripheral surface 134. Thus, one could smooth and polish a curved, ridged, waved or other irregular surface, if needed, to remove and reduce both large and small asperities, resulting in a mirror finish of a surface that, nonetheless, is not flat in the absolute sense. This same method described for polishing the outer peripheral surface 134 of the longitudinal extension 124 of the volume of superabrasive material 104 may also be applied to polish the cutting face 108, the chamfer 116, and/or any portion of the lateral side surface 136 of the cutting element 100.

The outer peripheral surface 134 of the longitudinal extension 124 may be polished by other methods, such as ion beams or chemicals, although the inherently inert chemical nature of diamond may make the latter approach somewhat difficult for diamond. In other embodiments, the outer peripheral surface 134 may be polished by a laser polishing process, as described in the aforementioned U.S. patent application Ser. No. 13/461,388, filed May 1, 2012, now U.S. Pat. No. 8,991,525, issued Mar. 31, 2015, in the name of Bilen et al.; and United States Patent Publication No. 2009/0114628 A1, published May 7, 2009, to DiGiovanni.

Figure 5A:
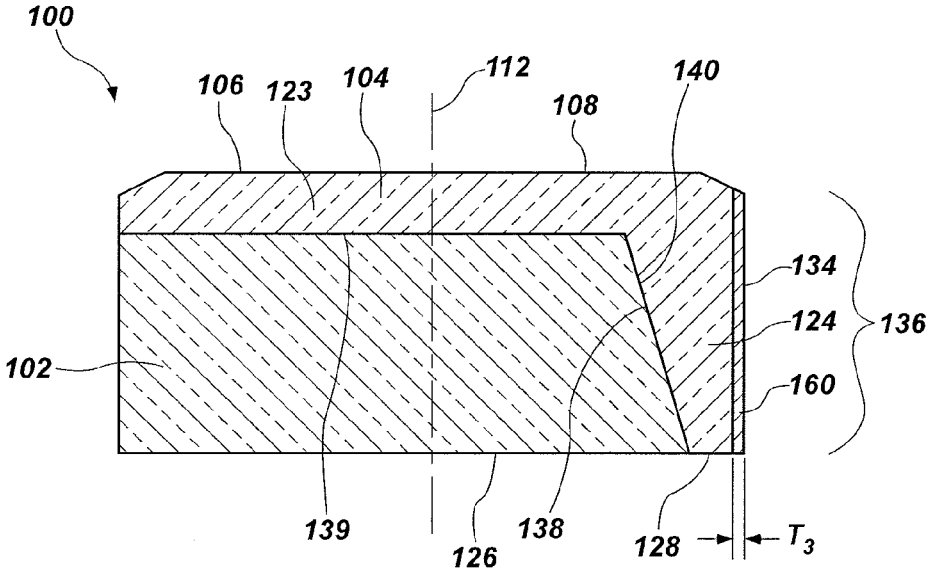
FIG. 5A illustrates a cross-sectional view of a cutting element having a volume of superabrasive material with a longitudinal extension extending to a rear surface of the cutting element, according to an embodiment of the present disclosure.
Figure 5B:
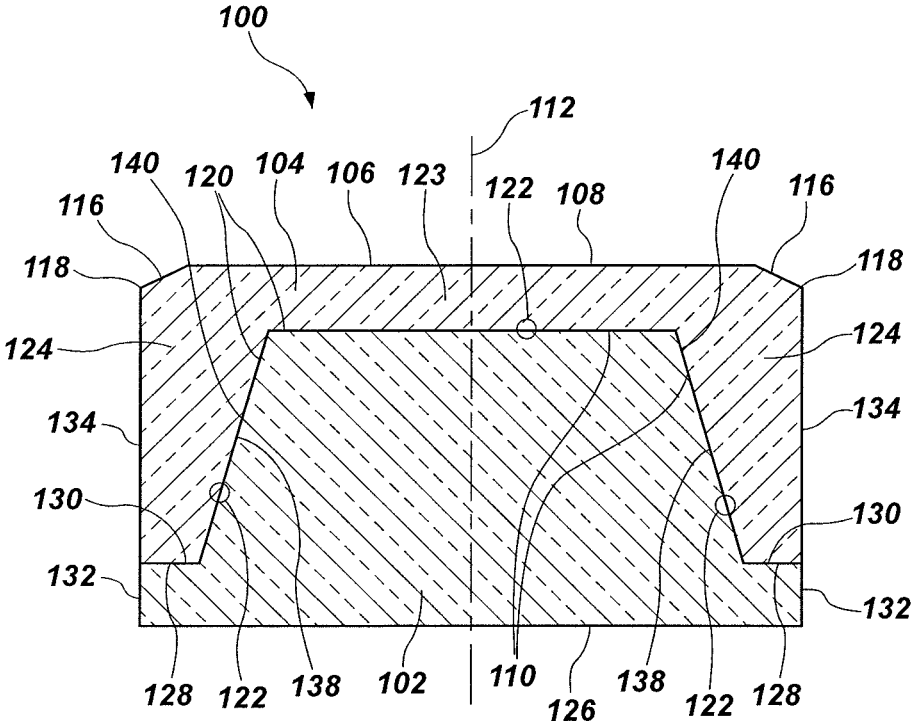
FIG. 5B illustrates a cross-sectional view of a cutting element having a volume of superabrasive material with a longitudinal extension extending circumferentially entirely around the cutting element about a longitudinal axis of the cutting element, in an annular configuration, according to an embodiment of the present disclosure.

In alternative embodiments, at least a portion of the outer peripheral surface 134 of the longitudinal extension 124 may be physically modified, such as by applying a conformal volume, or "coating," of diamond-like carbon (DLC) having a surface roughness less than about 10 μin. (about 0.254 μm) RMS thereto. In such embodiments, as shown in FIG. 5A, the outer peripheral surface 134 of the longitudinal extension 124 may have a coating 160 of DLC disposed over the volume of superabrasive material 104. The DLC coating 160 may be applied to the volume of superabrasive material 104 according to any of the methods described in U.S. Patent Publication No. 2009/0321146 A1, published Dec. 31, 2009, in the name of Dick et al.; and U.S. Patent Publication No. 2012/0205162 A1, published Aug. 16, 2012, in the name of Patel et al., the disclosure of each of which is incorporated herein in its entirety by this reference. For example, the DLC coating 160 may be disposed over the volume of superabrasive material 104 by one or more of a chemical vapor deposition (CVD) process, a plasma assisted chemical vapor deposition (PACVD) process, an ion beam deposition process, a cathodic arc spray process, a pulsed laser ablation process, and an argon ion sputtering process. In yet additional embodiments, at least a portion of the outer peripheral surface 134 of the longitudinal extension 124 may be physically modified, such as by applying, or "growing," a conformal volume, or "coating," such as the coating 160 illustrated in FIG. 5A, of synthetic diamond on the outer peripheral surface 134 by a chemical vapor deposition (CVD) process. Synthetic diamond applied in such a manner may be referred to as "CVD diamond." A conformal volume 160 of DLC material or CVD diamond may have a thickness $T_3$ in the range of about 5 μm to about 80 μm.

While an industry-standard PDC or other superhard cutting element may have a lapped surface finish on the cutting face with irregularities or roughness (measured vertically from the surface) on the order of 20 gin. (about 0.508 μm) to 40 μin. (about 1.02 μm) RMS, as a result of the above-described polishing, in some embodiments, the outer peripheral surface 134 of the longitudinal extension 124 of the volume of superabrasive material 104 may have a surface roughness between about 0.3 μin. (about 0.0076 μm) RMS and about 0.5 μin. (about 0.0127 μm) RMS. Additional embodiments may have portions of the outer peripheral surface 134 with a surface roughness between about 0.4 μin. (about 0.0102 μm) RMS and about 0.6 μin. (about 0.0152 μm) RMS. In yet additional embodiments, portions of the outer peripheral surface 134 may have a surface roughness less than about 10 μin. (about 0.254 μm) RMS. In further embodiments, portions of the outer peripheral surface 134 may have a surface roughness less than about 2 μin. (about 0.0508 μm) RMS. In yet further embodiments, portions of the outer peripheral surface 134 may have a surface roughness less than about 0.5 μin. (about 0.0127 μm) RMS, approaching a true "mirror" finish. In yet further additional embodiments, portions of the outer peripheral surface 134 may have a surface roughness less than about 0.1 μin. (about 0.00254 μm). The foregoing surface roughness measurements of the volume of superabrasive material 104 may be measured using a calibrated HOMMEL® America Model T-4000 diamond stylus profilometer contacting the outer peripheral surface 134 of the longitudinal extension 124 of the volume of superabrasive material 104.

Figure 8:
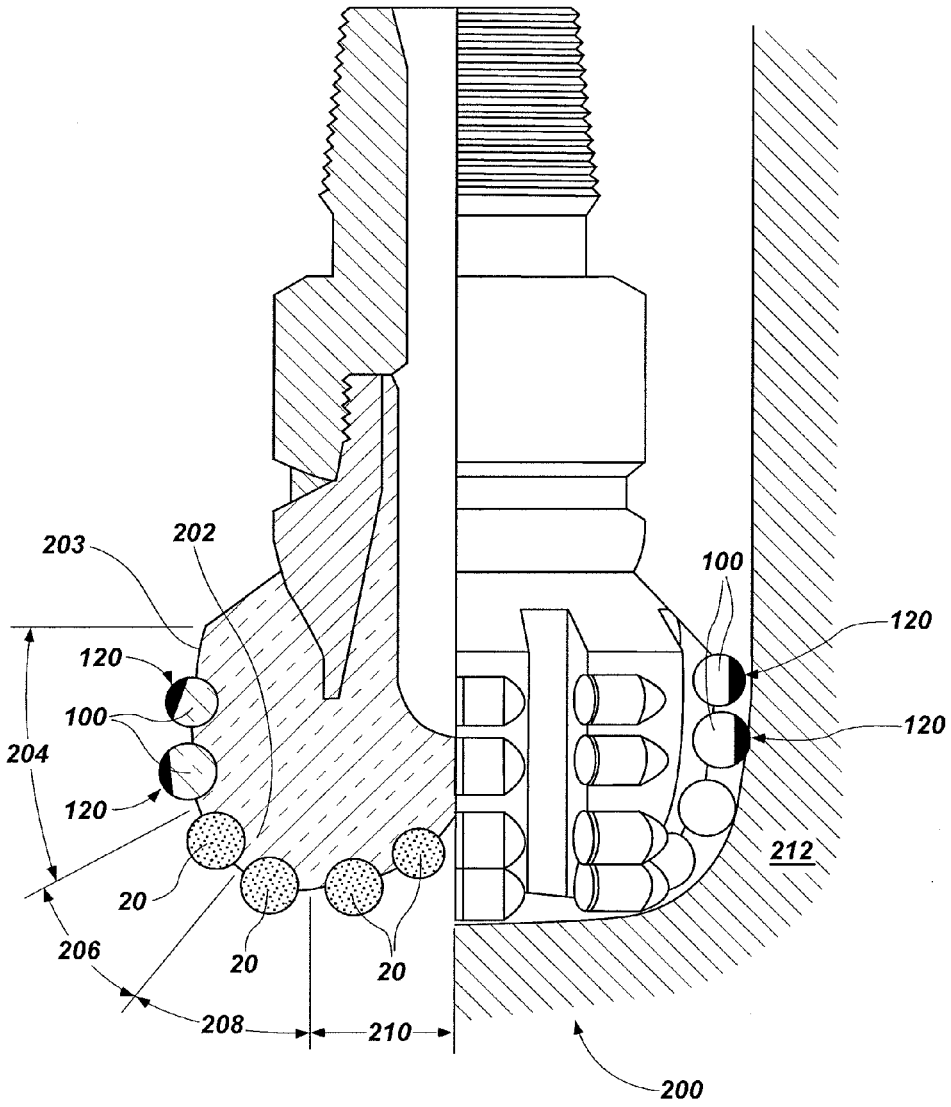
FIG. 8 illustrates a partial cross-sectional plan view of a drill bit having a cutting element with a longitudinal extension affixed to a gauge region of a blade of the drill bit, according to an embodiment of the present disclosure.

Referring now to FIG. 8, a drill bit 200 is illustrated, similar to the drill bit 10 of FIG. 1, showing a partial cross-sectional view of a blade 202 having one or more cutting elements in each of a gauge region 204, a shoulder region 206, a nose region 208 and a cone region 210. In some instances, friction with the wellbore at the gauge region 204 may be more problematic in terms of causing bit "whirl," wherein a bit rotates or precesses in the borehole counter to the direction of bit rotation by the drill string or downhole motor. In particular, friction at the gauge region 204 imparts greater torque to the drill bit 200 than the same amount of friction at the shoulder region 206, the nose region 208 or the cone region 210. To reduce the amount of friction between the wellbore and the gauge region 204 of the drill bit 200, one or more cutting elements 100, configured as previously described, may be affixed to a blade 202 of the drill bit 200 at the gauge region 204. The shaded portions of the cutting elements 100 indicate the general location of the longitudinal extension 124 of the volume of superabrasive material 104 on the cutting elements 100. For example, as shown in FIG. 8, each of the cutting elements 100 is oriented on a face 203 of the bit body such that the respective longitudinal extensions 124 are each located proximate a point of contact between the respective cutting element 100 and a subterranean formation material 212 during use of the drill bit 200 in an earth-boring operation. Other cutting elements 20 may be located in the shoulder region 206, the nose region 208 or the cone region 210 of the drill bit 200. In other embodiments, cutting elements 100, configured as previously described, may additionally be located in one or more of any of the shoulder region 206, the nose region 208 or the cone region 210 of the drill bit 200. In yet other additional embodiments, a cutting element 100, configured as previously described, may be affixed to other earth-boring tools in a drill string located up-hole of a pilot bit.

Embodiments of cutting elements of the present disclosure may be used to attain one or more of the advantages described above. For example, such cutting elements may reduce friction between the drill bit and the uncut formation. In addition, such cutting elements may reduce physical and thermal degradation of constituent components of the cutting elements, including "heat checking" of the substrate, as the condition is known in the art. Such cutting elements may also reduce or prevent the occurrence of bit "whirl" on the drill string.

Additional non-limiting example embodiments of the present disclosure are set forth below.

Embodiment 1: A cutting element for an earth-boring tool, comprising: a substrate; and a volume of superabrasive material disposed over the substrate, the volume of superabrasive material including: a first major surface comprising a front cutting face of the volume of superabrasive material; and a longitudinal extension extending longitudinally along a lateral side surface of the substrate, the longitudinal extension having an outer peripheral surface, the outer peripheral surface of the longitudinal extension defining at least a portion of a lateral side surface of the cutting element, wherein at least a portion of the outer peripheral surface of the longitudinal extension has a surface roughness less than about 10 μin. (about 0.254 μm) RMS.

Embodiment 2: The cutting element of Embodiment 1, wherein the at least a portion of the outer peripheral surface of the longitudinal extension of the volume of superabrasive material has a surface roughness less than about 2 μin. (about 0.0508 μm) RMS.

Embodiment 3: The cutting element of Embodiment 1 or Embodiment 2, wherein the at least a portion of the outer peripheral surface of the longitudinal extension of the volume of superabrasive material has a surface roughness less than about 0.5 μin. (about 0.0127 μm) RMS.

Embodiment 4: The cutting element of any one of Embodiments 1 through 3, wherein the longitudinal extension of the volume of superabrasive material extends circumferentially entirely around the cutting element in an annular configuration about a longitudinal axis of the cutting element.

Embodiment 5: The cutting element of any one of Embodiments 1 through 4, wherein the at least a portion of the outer peripheral surface of the longitudinal extension of the volume of superabrasive material comprises a conformal volume of at least one of diamond-like carbon (DLC) and a CVD diamond material disposed over the volume of superabrasive material.

Embodiment 6: The cutting element of any one of Embodiments 1 through 5, wherein the longitudinal extension of the volume of superabrasive material is configured to be located on an earth-boring tool proximate a point of contact between the cutting element and a subterranean formation material to be cut.

Embodiment 7: The cutting element of any one of Embodiments 1 through 6, wherein the longitudinal extension of the volume of superabrasive material is further configured such that a wear-flat formed in the cutting element during use of the cutting element to cut a subterranean formation material is substantially fully encompassed by the volume of superabrasive material.

Embodiment 8: An earth-boring tool, comprising: a tool body having at least one cutting element affixed thereto, the at least one cutting element comprising: a substrate; and a volume of superabrasive material disposed over the substrate, the volume of superabrasive material including: a first major surface comprising a front cutting face of the volume of superabrasive material; and a longitudinal extension extending longitudinally along a lateral side surface of the substrate, the longitudinal extension having an outer peripheral surface, the outer peripheral surface of the longitudinal extension defining at least a portion of a lateral side surface of the at least one cutting element, wherein at least a portion of the outer peripheral surface of the longitudinal extension has a surface roughness less than about 10 μin. (about 0.254 μm) RMS.

Embodiment 9: The earth-boring tool of Embodiment 8, wherein the at least a portion of the outer peripheral surface of the longitudinal extension of the volume of superabrasive material has a surface roughness less than about 2 μin. (about 0.0508 μm) RMS.

Embodiment 10: The earth-boring tool of Embodiment 8 or Embodiment 9, wherein the at least a portion of the outer peripheral surface of the longitudinal extension of the volume of superabrasive material has a surface roughness less than about 0.5 μin. (about 0.0127 μm) RMS.

Embodiment 11: The earth-boring tool of any one of Embodiments 8 through 10, wherein the at least a portion of the outer peripheral surface of the longitudinal extension of the volume of superabrasive material has a surface roughness less than about 0.2 μin. (about 0.0051 μm) RMS.

Embodiment 12: The earth-boring tool of any one of Embodiments 8 through 11, wherein the at least a portion of the outer peripheral surface of the longitudinal extension of the volume of superabrasive material comprises a conformal volume of at least one of a diamond-like carbon (DLC) and a CVD diamond disposed over the volume of superabrasive material.

Embodiment 13: The earth-boring tool of any one of Embodiments 8 through 12, wherein the at least one cutting element is oriented on a face of the tool body such that the longitudinal extension of the volume of superabrasive material is located proximate a point of contact between the at least one cutting element and a subterranean formation material during use of the earth-boring tool in a boring operation.

Embodiment 14: The earth-boring tool of any one of Embodiments 8 through 13, wherein the longitudinal extension of the volume of superabrasive material is further configured such that a wear-flat formed in the at least one cutting element during use of the at least one cutting element to cut a subterranean formation material is substantially fully encompassed by the volume of superabrasive material.

Embodiment 15: A method of forming a cutting element for an earth-boring tool, comprising: providing a substrate; disposing a volume of superabrasive material over the substrate, the volume of superabrasive material including: a first major surface comprising a front cutting face of the volume of superabrasive material; and a longitudinal extension extending longitudinally along a lateral side surface of the substrate, the longitudinal extension having an outer peripheral surface defining at least a portion of a lateral side surface of the cutting element; and polishing at least a portion of the outer peripheral surface of the longitudinal extension to a surface roughness less than about 10 μin. (about 0.254 μm) RMS.

Embodiment 16: The method of Embodiment 15, wherein polishing the at least a portion of the outer peripheral surface of the longitudinal extension to a surface roughness less than about 10 μin. (about 0.254 μm) RMS comprises disposing a conformal volume of at least one of a diamond-like carbon (DLC) and CVD diamond over the at least a portion of the outer peripheral surface of the longitudinal extension, an exposed surface of the conformal volume having a surface roughness less than about 2 μin. (about 0.0508 μm) RMS.

Embodiment 17: The method of Embodiment 15 or Embodiment 16, wherein polishing at least a portion of the outer peripheral surface of the longitudinal extension to a surface roughness less than about 2 μin. (about 0.0508 μm) RMS comprises performing at least one of a laser polishing process, a lapping process, a rotating diamond wheel polishing process, an ion beam polishing process, and a chemical polishing process.

Embodiment 18: The method of any one of Embodiments 15 through 17, further comprising affixing the cutting element to a tool body of an earth-boring tool.

Embodiment 19: The method of any one of Embodiments 15 through 18, further comprising orienting the cutting element such that the longitudinal extension of the volume of superabrasive material is located proximate a point of contact between the cutting element and a subterranean formation material during use of the earth-boring tool in a drilling operation.

Embodiment 20: The method of any one of Embodiments 15 through 19, wherein disposing a volume of superabrasive material over the first major surface of the substrate comprises configuring the longitudinal extension of the volume of superabrasive material such that a wear-flat formed in the at least one cutting element during use of the at least one cutting element to cut a subterranean formation material is substantially fully encompassed by the volume of superabrasive material.

Although the foregoing description and example embodiments contains many specifics, these are not to be construed as limiting the scope of the present disclosure, but merely as providing certain example embodiments. Similarly, other embodiments of the disclosure may be devised that are within the scope of the present disclosure. For example, features described herein with reference to one embodiment may also be combined with features of other embodiments described herein. The scope of the disclosure is, therefore, indicated and limited only by the appended claims, rather than by the foregoing description. All additions, deletions, and modifications to the devices, apparatuses, systems and methods, as disclosed herein, which fall within the meaning and scope of the claims, are encompassed by the present disclosure.

What is claimed is:

1. A cutting element for an earth-boring tool, comprising:

a substrate; and a volume of superabrasive material disposed over the substrate, the volume of superabrasive material including:

a first portion comprising:

a first major surface comprising a front cutting face of the volume of superabrasive material;

a lateral side surface adjacent the first major surface; and a rear surface opposite the first major surface and at least substantially parallel thereto; and a longitudinal extension extending longitudinally rearward from the rear surface of the first portion and along a lateral side surface of the substrate, the longitudinal extension having a back end and an outer peripheral surface, the back end being substantially parallel to the rear surface of the first portion and having a substantially planar surface abutting a substantially planar landing of the substrate and the outer peripheral surface of the longitudinal extension defining at least a portion of a lateral side surface of the cutting element, wherein at least a portion of the outer peripheral surface of the longitudinal extension has a surface roughness less than about 10 μin. (about 0.254 μm) RMS, and wherein a total thickness of the cutting element between the front cutting face of the first portion and a rear surface of the substrate opposite the volume of superabrasive material is between about 5 mm and about 30 mm, a first thickness between the front cutting face of the first portion and the back end of the longitudinal extension is between about 70% and about 100% of the total thickness of the cutting element, and a second thickness between the front cutting face of the volume of superabrasive material and the rear surface of the first portion of the volume of superabrasive material is between about 0.2 mm and about 5.0 mm.

2. The cutting element of claim 1, wherein the at least a portion of the outer peripheral surface of the longitudinal extension of the volume of superabrasive material has a surface roughness less than about 2 μin. (about 0.0508 μm) RMS.

3. The cutting element of claim 1, wherein the at least a portion of the outer peripheral surface of the longitudinal extension of the volume of superabrasive material has a surface roughness less than about 0.5 μin. (about 0.0127 μm) RMS.

4. The cutting element of claim 1, wherein the longitudinal extension of the volume of superabrasive material extends circumferentially entirely around the cutting element in an annular configuration about a longitudinal axis of the cutting element.

5. The cutting element of claim 1, wherein the at least a portion of the outer peripheral surface of the longitudinal extension of the volume of superabrasive material comprises a conformal volume of at least one of a diamond-like carbon (DLC) and a chemical vapor deposition (CVD) diamond material disposed over the volume of superabrasive material.

6. The cutting element of claim 1, wherein the longitudinal extension of the volume of superabrasive material is configured to be located on an earth-boring tool proximate a point of contact between the cutting element and a subterranean formation material to be cut.

7. The cutting element of claim 6, wherein the longitudinal extension of the volume of superabrasive material is further configured such that a wear-flat formed in the cutting element during use of the cutting element to cut the subterranean formation material is substantially fully encompassed by the volume of superabrasive material.

8. An earth-boring tool, comprising:

a tool body having at least one cutting element affixed thereto, the at least one cutting element comprising:

a substrate; and a volume of superabrasive material disposed over the substrate, the volume of superabrasive material including:

a first portion comprising:

a first major surface comprising a front cutting face of the volume of superabrasive material;

a lateral side surface adjacent the first major surface; and a rear surface opposite the first major surface and at least substantially parallel thereto; and a longitudinal extension extending longitudinally rearward from the rear surface of the first portion and along a lateral side surface of the substrate, the longitudinal extension having a back end and an outer peripheral surface, the back end being substantially parallel to the rear surface of the first portion and having a substantially planar surface abutting a substantially planar landing of the substrate and the outer peripheral surface of the longitudinal extension defining at least a portion of a lateral side surface of the at least one cutting element, wherein at least a portion of the outer peripheral surface of the longitudinal extension has a surface roughness less than about 10 μin. (about 0.254 μm) RMS, and wherein a total thickness of the at least one cutting element between the front cutting face of the first portion and a rear surface of the substrate opposite the volume of superabrasive material is between about 5 mm and about 30 mm, a first thickness between the front cutting face of the first portion and the back end of the longitudinal extension is between about 70% and about 100% of the total thickness of the at least one cutting element, and a second thickness between the front cutting face of the volume of superabrasive material and the rear surface of the first portion of the volume of superabrasive material is between about 0.2 mm and about 5.0 mm.

9. The earth-boring tool of claim 8, wherein the at least a portion of the outer peripheral surface of the longitudinal extension of the volume of superabrasive material has a surface roughness less than about 2 μin. (about 0.0508 μm) RMS.

10. The earth-boring tool of claim 8, wherein the at least a portion of the outer peripheral surface of the longitudinal extension of the volume of superabrasive material has a surface roughness less than about 0.5 μin. (about 0.0127 μm) RMS.

11. The earth-boring tool of claim 8, wherein the at least a portion of the outer peripheral surface of the longitudinal extension of the volume of superabrasive material has a surface roughness less than about 0.2 μin. (about 0.0051 μm) RMS.

12. The earth-boring tool of claim 8, wherein the at least a portion of the outer peripheral surface of the longitudinal extension of the volume of superabrasive material comprises a conformal volume of at least one of a diamond-like carbon (DLC) and a chemical vapor deposition (CVD) diamond material disposed over the volume of superabrasive material.

13. The earth-boring tool of claim 8, wherein the at least one cutting element is oriented on a face of the tool body such that the longitudinal extension of the volume of superabrasive material is located proximate a point of contact between the at least one cutting element and a subterranean formation material during use of the earth-boring tool in a boring operation.

14. The earth-boring tool of claim 13, wherein the longitudinal extension of the volume of superabrasive material is further configured such that a wear-flat formed in the at least one cutting element during use of the at least one cutting element to cut the subterranean formation material is substantially fully encompassed by the volume of superabrasive material.

15. A method of readying a cutting element for use on an earth-boring tool, comprising:

providing a substrate;

disposing a volume of superabrasive material over the substrate, the volume of superabrasive material including:

a first portion comprising:

a first major surface comprising a front cutting face of the volume of superabrasive material;

a lateral side surface adjacent the first major surface; and a rear surface opposite the first major surface and at least substantially parallel thereto; and a longitudinal extension extending longitudinally rearward from the rear surface of the first portion and along a lateral side surface of the substrate, the longitudinal extension having a back end and an outer peripheral surface, the back end being substantially parallel to the rear surface of the first portion and having a substantially planar surface abutting a substantially planar landing of the substrate and the outer peripheral surface of the longitudinal extension defining at least a portion of a lateral side surface of the cutting element; and polishing at least a portion of the outer peripheral surface of the longitudinal extension to a surface roughness less than about 10 μin. (about 0.254 μm) RMS, and wherein a total thickness of the cutting element between the front cutting face of the first portion and a rear surface of the substrate opposite the volume of superabrasive material is between about 5 mm and about 30 mm, a first thickness between the front cutting face of the first portion and the back end of the longitudinal extension is between about 70% and about 100% of the total thickness of the cutting element, and a second thickness between the front cutting face of the volume of superabrasive material and the rear surface of the first portion of the volume of superabrasive material is between about 0.2 mm and about 5.0 mm.

16. The method of claim 15, wherein polishing the at least a portion of the outer peripheral surface of the longitudinal extension to a surface roughness less than about 10 μin. (about 0.254 μm) RMS comprises disposing a conformal volume of at least one of a diamond-like carbon (DLC) and a chemical vapor deposition (CVD) diamond material over the at least a portion of the outer peripheral surface of the longitudinal extension, an exposed surface of the conformal volume having a surface roughness less than about 2 μin. (about 0.0508 μm) RMS.

17. The method of claim 15, wherein polishing at least a portion of the outer peripheral surface of the longitudinal extension to a surface roughness less than about 2 μin. (about 0.0508 μm) RMS comprises performing at least one of a laser polishing process, a lapping process, a rotating diamond wheel polishing process, an ion beam polishing process, and a chemical polishing process.

18. The method of claim 15, further comprising affixing the cutting element to a tool body of an earth-boring tool.

19. The method of claim 18, further comprising orienting the cutting element such that the longitudinal extension of the volume of superabrasive material is located proximate a point of contact between the cutting element and a subterranean formation material during use of the earth-boring tool in a drilling operation.

20. The method of claim 15, wherein disposing a volume of superabrasive material over the substrate comprises configuring the longitudinal extension of the volume of superabrasive material such that a wear-flat formed in the cutting element during use of the cutting element to cut a subterranean formation material is substantially fully encompassed by the volume of superabrasive material.

* * * * *